United States Patent [19]

Loos

[11] 4,210,071

[45] Jul. 1, 1980

[54] MOUNTING FOR ROOM AIR CONDITIONER ACCESS DOOR

[75] Inventor: John H. Loos, Dayton, Ohio

[73] Assignee: White Consolidated Industries, Inc., Cleveland, Ohio

[21] Appl. No.: 965,902

[22] Filed: Dec. 4, 1978

[51] Int. Cl.[2] ..... E06B 7/02; F25D 23/12

[52] U.S. Cl. ..... 98/94 AC; 62/262

[58] Field of Search ..... 62/262; 312/236; 98/94

[56] References Cited

U.S. PATENT DOCUMENTS

| | | | |
|---|---|---|---|
| 3,306,645 | 2/1967 | Maleck | 62/262 X |
| 3,323,319 | 6/1967 | Graser | 62/262 |
| 3,592,123 | 7/1971 | Henken et al. | 98/94 |
| 4,065,027 | 12/1977 | Ruark et al. | 220/343 |

*Primary Examiner*—Lloyd L. King

*Attorney, Agent, or Firm*—Pearne, Gordon, Sessions

[57] ABSTRACT

A door construction for hingedly mounting a room air conditioner control area access door on the front cover panel. The door includes an L-shaped angle extension formed integrally with the door rearwardly pivoted vertical edge. The construction defines a recessed shoulder positioned in an offset manner from the door outer face so as to underlie a free edge of the panel when the door and panel are in co-planar relation to limit inward flexing of the panel. The angle is further adapted, upon opening of the door, to be movable into engagement with a portion of the control area housing to positively limit the pivotal location of the door to obviate contact of the door outer decorative face with the panel frec edge.

2 Claims, 5 Drawing Figures

MOUNTING FOR ROOM AIR CONDITIONER ACCESS DOOR

This invention relates to room air conditioning units and more particularly to an arrangement for mounting a pivoting access door on the unit's front assembly for covering the control area.

In room air conditioning units it is desirable to include a panel for covering the unit's control area to provide a decorative appearance which will blend harmoniously with the appointments in the room. One approach to improving the aesthetic appearance of an air conditioner unit includes unitary roomside framework on which is located a sliding baffle as shown, for example, in U.S. Pat. No. 3,592,123 to F. C. Henken, and assigned to the same assignee as the present application. The U.S. Pat. No. 4,065,027 to Ruark et al, discloses an apparatus for hingedly mounting a control access door on a room air conditioner to cover the unit's control panel.

Accordingly, it is an object of the present invention to provide an improved front assembly for an air conditioner that includes a unitary framework on which is located a pivoting access door covering the control area to improve the aesthetic appearance of the unit when in its window or wall located position within a room.

Another object of the present invention is to provide an improved low cost front assembly for a room air conditioner which includes unitary framework having a generally flat flexible baffle panel vertically disposed on the frame having a decorative outer face such that the panel defines with the portions of the frame an opening providing access to the unit's control area. A pivoting access door for the opening has a decorative outer face conforming with the panel face with the door normally closing the access opening. The one-piece molded door includes hinge means aligned on a vertical pivotal axis spaced a predetermined distance from the door vertical edge whereby the door is partially pivoted within the front assembly when opened.

It is yet another object of the present invention to provide a unitary front assembly for an air conditioner as set forth in the preceding object wherein the baffle panel has one free edge spaced from one vertical side portion of the frame whereby upon the door being opened its decorative face is pivoted rearwardly to a location normally resulting in contact with the panel free edge. An extension is formed at the vertical door edge substantially coextensive therewith and disposed with a portion of the extension defining a recessed shoulder positioned so as to underline the panel free edge in a concealed manner when the door and panel are in the coplanar relation to limit inward flexing of the panel.

It is still another object of the present invention to provide an improved pivotal door for an air conditioning front assembly as set forth in the preceding above object, whereby upon opening of the door a portion of the extension is moved into engagement with a portion of the unit's inner housing to positively limit the pivotal location of the door thereby obviating contact of the door outer decorative surface with the panel free edge.

Further objects and advantages of the present invention will be apparent from the following description, reference being had to the accompanying drawings wherein a preferred embodiment of the present invention is clearly shown.

Figure 1:
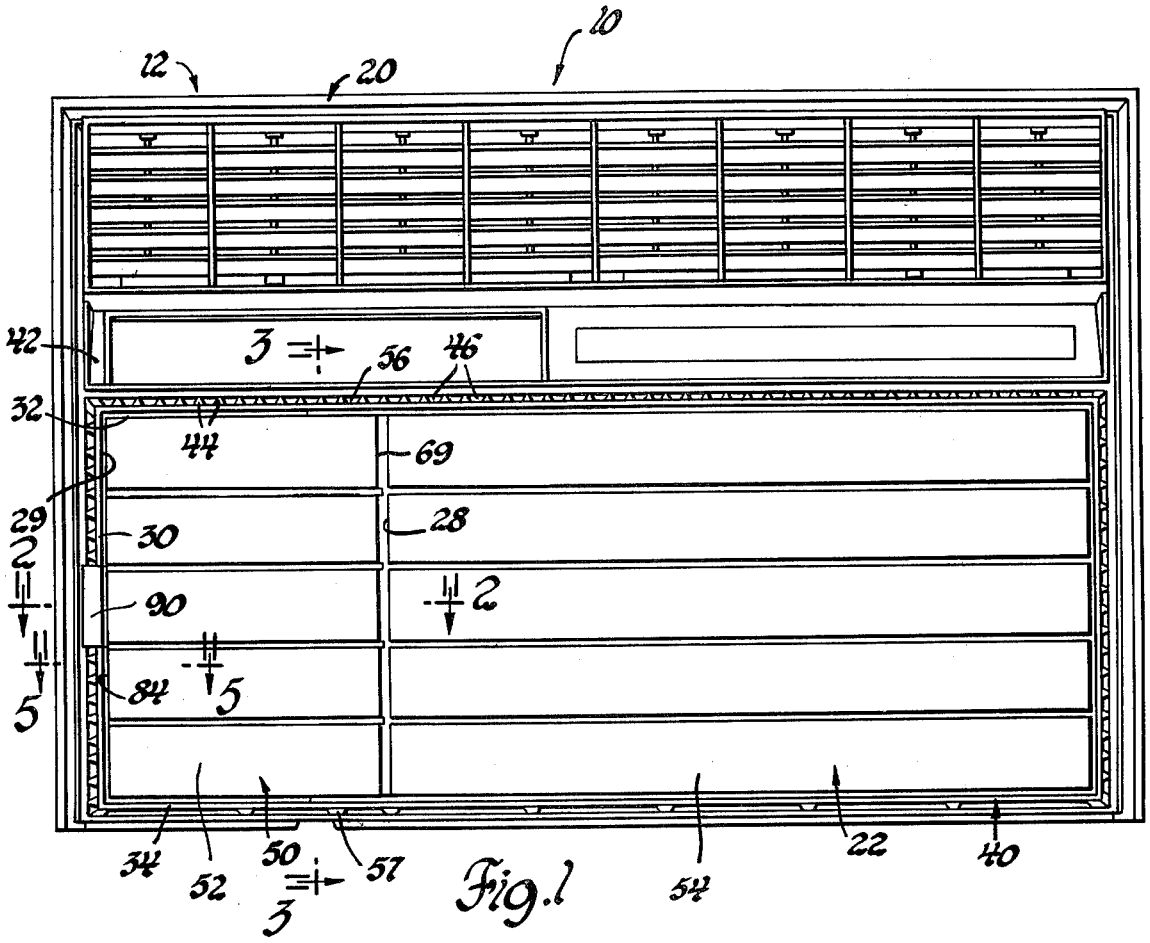
FIG. 1 is a view in front elevation of an air conditioner front assembly showing the door mounting arrangement of the present invention.

Referring now to the drawings, a room air conditioner 10 is illustrated in FIG. 1 of the type adapted to be mounted or supported within a window frame opening. The air conditioner 10 includes a front assembly 12 designed to enclose a front opening 14 (FIG. 3) in a sleeve-like cabinet 16. The cabinet includes a top (not shown) and bottom 17 joining side walls, one of which is illustrated at 18. Additionally, the cabinet includes a back (not shown).

Figure 2:
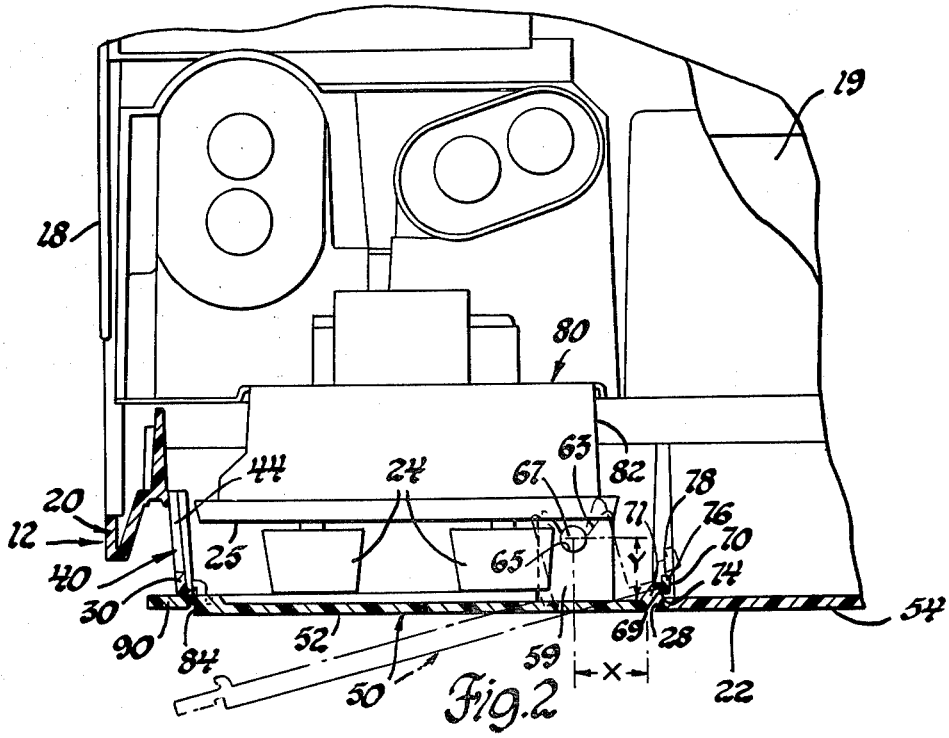
FIG. 2 is an enlarged fragmentary horizontal sectional view taken on line 2—2 of FIG. 1, showing details of the control area access door mounting.

For the purpose of the present invention, it is only necessary to understand that the cabinet 16 serves to enclose the operative components of the air conditioner unit including an evaporator partially shown at 19 in FIG. 2 which is typically located at the front of the cabinet 16 across most of the planar extent thereof; an air conditioner fan (not shown) for drawing air across the evaporator for cooling it and then returning the circulated air back into a room being cooled by the unit. The front assembly 12 includes a peripheral rectangular frame 20 connected on the cabinet 16 room side.

The front assembly frame 20 supports a baffle front panel, generally indicated at 22, that serves to damp noise emitting from the cabinet 16 and additionally serves to cover control components 24 of a control area 25 that regulate the operation of the unit. The baffle front panel 22 is in the form of a generally flat flexible baffle panel vertically disposed on a baffle frame 40 having a decorative outer face 54. The integral front cover assembly is preferably made of high-impact polystyrene material.

Figure 3:
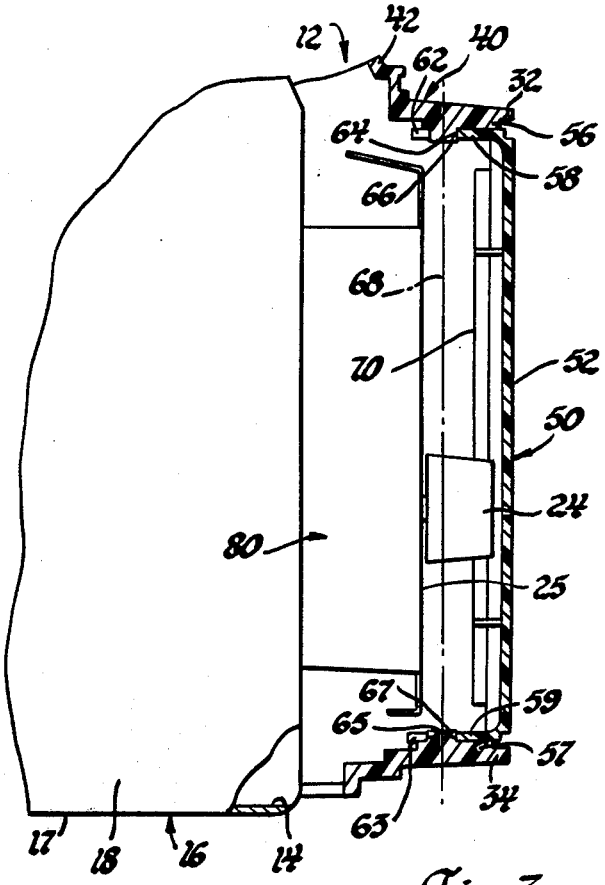
FIG. 3 is an enlarged fragmentary vertical sectional view taken on line 3—3 of FIG. 1 through the pivotal connections of the access door.

As best seen in FIGS. 1, 2 and 3, the baffle panel 22 includes one vertical free side edge 28, shown inwardly beveled in FIG. 2, spaced a predetermined distance from a vertical side edge 29 of a vertical frame member 30 defining, with top 32 and bottom 34 opposed frame portions, a rectangular opening providing access to the control area 25.

The baffle front panel is supported on the forwardly located front frame 40 integrally connected to a center cross-piece 42 by a plurality of inclined reinforcing ribs 44 which are located at spaced-apart points across the full width of the baffle front. More particularly, the baffle panel 22 is supported by the front frame 40 to overlie, with control area access door 50, substantially the full planar extent of the inlet in the front assembly to provide a highly effective noise shield between the operative components within the cabinet 16 and the room interior. The reinforcing ribs 44 cooperate to define a plurality of inlet openings 46 at a point immediately below the upwardly and forwardly inclined cross-piece 42.

As seen in FIG. 1 the door 50 has a decorative outer face 52, conforming with the face 54 of panel 22, and closes the control area access opening such that the door outer face 52 is positioned in substantially co-planar relation with the panel outer face 54.

As best seen in FIGS. 2 and 3, hinge means are provided in spaced relation with the right-hand corner for pivotally mounting the door 50 on the opposed top 56 and bottom 57 frame reinforcing ribs. The hinge means include upper 58 and lower 59 identical hinge bearing blades integral with the door inner face and which extend parallel to each other in horizontally disposed planes. The hinge upper and lower blades 58 and 59 each have a slot comprising a lead-in V-shaped open end 62 and 63 respectively, at their free or distal edges and an inner semi-circular bearing portion 64 and 65 at their closed end, respectively. The blades are arranged so that when the door is closed, as seen in FIG. 2, the blades have their V-shaped open ends facing inwardly. Each rib 56, 57 has integral short studs or posts 66, 67 formed on its inner face so as to be in opposed vertically aligned relation on the door pivotal axis shown at 68 in FIG. 3. The slot semi-circular bearing portions conform to the hinge posts and include a reduced entrance (not shown) whereby the door blades are adapted for snap-on removable retention engagement with their associated upper and lower post.

It will be noted in FIG. 2 that the pivotal vertical axis 68 of the posts 66, 67 is spaced a predetermined distance "X" from the door vertically extending right hand door edge corner 69 and a predetermined distance "Y" from the inner surface of the door 50. In the form shown "X" is about 0.98 in. and "Y" is about 0.60 in. while the door 50 has an overall height of about 6.85 in. and a width of about 5.23 in. Thus upon the door 50 being pivoted or swung from the left hand edge 84 to its fully opened position of FIG. 4 the corner 69 is recessed about one-third of the door width rearwardly of panel face 54. The result is that the door's decorative face 52 is moved or pivoted to a location which would normally result in contact with the free edge 28 of baffle panel 24. To this end applicant has provided an L-shaped or sectioned angle extension 70 integrally formed at the door vertically extending beveled rib 71 defining, with the door, right hand edge corner 69. As seen in FIG. 3, the L-shaped extension 70 is substantially coextensive with the door edge 69.

Figure 4:
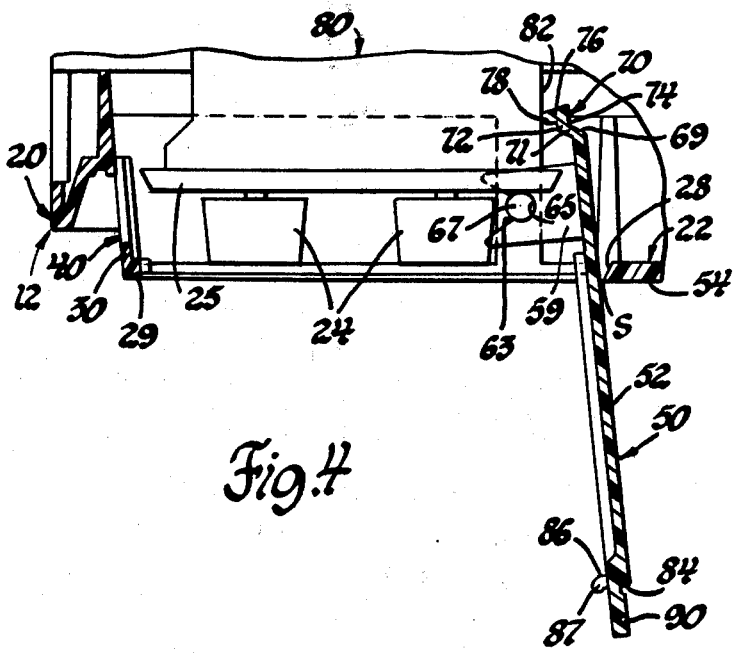
FIG. 4 is a view similar to FIG. 2 showing the access door in its fully opened position.

As seen in FIGS. 2 and 4, the L-shaped extension 70 is disposed with its first leg 72 defining a recessed shoulder 74 positioned sufficiently offset from the outer face 52 of the door so as to underlie the panel free edge 28 when the door and panel are in their co-planar door closed (FIG. 2) relation. It will be appreciated that ordinarily the panel free edge 28 is free to flex inwardly in an undesirable manner because of the panel's thin section which has a thickness of the order of 0.120 inches. Thus, by providing the shoulder 64 as shown it operates to limit inward flexing of the panel 24 while concealing from view the L-shaped angle extension 70.

The second leg 76 of the L-shaped angle extension 70 is shown extending rearwardly from the first leg 72 at substantially a right angle. Thus, upon the opening of door 50 the L-shaped angle extension second leg 76 is moved into engagement with a portion of the control area housing means 80. In the form shown it will be seen in FIG. 4 that the free edge 78 of the second leg contacts the vertical side wall 82 of the housing means. The result is to positively limit the pivotal location of the door 50 to a predetermined location short of its normal location thereby obviating contact of the door outer decorative face 52 on the panel free edge 28. Thus, as seen in FIG. 4, a defined door open clearance space "S" is provided by applicant's door positioning or stop arrangement to prevent the door decorative surface or face 52 from being scratched or otherwise marred by striking the shart corner of the panel vertical beveled edge 28.

Figure 5:
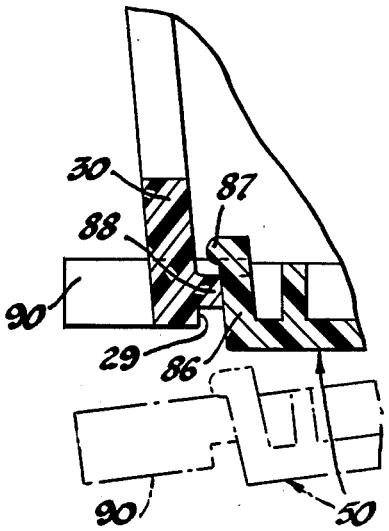
FIG. 5 is a further enlarged fragmentary, horizontal sectional view, taken on line 5—5 of FIG. 1, showing details of the door securing means.

As best seen in FIG. 5, the door 50 has its other outwardly swung left hand edge 84 secured by suitable means to the baffle frame vertical member 30. In the disclosed form the door has one or more inwardly projecting tabs 86 provided with arcuate protrusions 87 adapted to snap beyond inwardly projecting rib 88 of the frame member 30 to retain the door 50 in its closed position. An outwardly projecting handle portion 90 is provided on the door edge 84 and extends beyond the frame member 30 to allow the user to grasp the handle portion 90 for ready opening of the door.

While the embodiment of the present invention as herein disclosed constitutes a preferred form, it is to be understood that other forms might be adopted.

The embodiments of the invention in which an exclusive property or privilege is claimed are defined as follows:

1. A self-contained room air conditioner unit including an outer shell having a room side section with a control area thereon enclosed by housing means, a front cover assembly having a peripheral rectangular frame connected on said shell room side, a generally flat flexible baffle panel vertically disposed on said frame having a decorative outer face, said baffle panel having one free side edge spaced from one vertical side portion of said frame defining with opposed top and bottom frame portions an opening providing access to said control area, a door having a decorative outer face conforming with said panel face normally closing said access opening, wherein said door decorative outer face is positioned in substantially co-planar relation with said panel outer face; hinge means pivotally mounting said door on said opposed top and bottom frame portions, means for maintaining said door in its closed position, said hinge means aligned on a vertical pivotal axis spaced a predetermined distance from a vertical edge of said door, whereby upon said door being opened its decorative face is pivoted rearwardly to a location normally resulting in contact with said panel free edge, an L-shaped angle extension formed at said vertical door edge substantially coextensive therewith and disposed with a first leg of said L-shaped angle extension defining a recessed shoulder positioned sufficiently offset from the outer face of said door so as to underlie said panel free edge when the door and panel are in said co-planar relation to limit inward flexing of said panel while concealing from view said L-shaped angle extension, the second leg of said L-shaped angle extending rearwardly from said first leg, whereby upon the opening of said door said L-shaped angle extension second leg being movable into engagement with a portion of said control area housing means to positively limit the pivotal location of said door to a predetermined location short of said normal location thereby obviating contact of said door outer decorative surface with said panel free edge.

2. A self-contained room air conditioner unit including an outer shell having a room side section with a control area thereon enclosed by housing means, a front cover assembly having a peripheral rectangular frame connected on said shell room side, a generally flat flexible baffle panel vertically disposed on said frame having a decorative outer face, said baffle panel having one free side edge spaced from one vertical side portion of said frame defining with opposed top and bottom frame portions an opening providing access to said control area, a door having a decorative outer face conforming with said panel face normally closing said access opening, wherein said door decorative outer face is positioned in substantially co-planar conforming relation with said panel outer face; hinge means pivotally mounting top and bottom edges of said door upon said opposed top and bottom frame portions, latch means on one vertical edge of said door normally interlockable with a keeper element on said frame side portion for maintaining said door in its closed position, said hinge means including upper and lower fixed studs formed on said frame top and bottom sides, respectively; said studs aligned on a vertical pivotal axis spaced a predetermined distance from said door other vertical edge, whereby upon said door being opened its decorative face is pivoted rearwardly to a location normally resulting in contact with said panel free edge, said door having upper and lower integral flat hinge plates extending rearwardly in cantilever fashion from the top and bottom edges of said door, respectively; a longitudinally disposed notch in each said hinge plate with the open end of each said notch aligned on said pivotal axis, whereby with the door in its closed position said hinge plate notches are releasably received and retained on their associated hinge studs for pivotal movement of said door on said axis, said other vertical door edge being beveled to provide clearance with said panel free edge upon opening of said door, an L-shaped angle extension formed at said other vertical door edge substantially coextensive therewith and disposed with a first leg of said L-shaped angle extension defining a recessed shoulder positioned so as to underlie said panel free edge to limit inward flexing of said panel while concealing from view said L-shaped angle extension, the second leg of said L-shaped angle extension extending rearwardly from said first leg, whereby upon the opening of said door said L-shaped angle extension second leg being movable into engagement with a portion of said control area housing means to positively limit the normal pivotal movement of said door to a predetermined location thereby obviating contact of said door outer decorative surface with said panel free edge.

* * * * *